United States Patent [19]

Barlow

[11] Patent Number: 4,616,559

[45] Date of Patent: Oct. 14, 1986

[54] VARIABLE AIR DIFFUSER

[75] Inventor: Raymond S. Barlow, Tucson, Ariz.

[73] Assignee: Pure Air Inc., Bethel, Conn.

[21] Appl. No.: 736,174

[22] Filed: May 20, 1985

[51] Int. Cl.[4] ..... F24F 13/06

[52] U.S. Cl. ..... 98/40.11; 98/40.15; 98/40.16; 98/41.3; 98/34.5

[58] Field of Search ..... 98/40.11, 40.15, 40.16, 98/40.05, 34.6, 41.3, 40 D, 33 A, 41 SV

[56] References Cited

U.S. PATENT DOCUMENTS 4,181,253 1/1980 Barlow ..... 98/49

FOREIGN PATENT DOCUMENTS 183856 3/1963 Sweden ..... 98/39.1

*Primary Examiner*—Larry I. Schwartz

*Attorney, Agent, or Firm*—Mattern, Ware, Stoltz & Fressola

[57] ABSTRACT

Variable flow of either primary air or of a mixture of primary and secondary air is provided to an enclosure by an air diffuser adapted for installation in an opening in the enclosure. Sleeve means is movably mounted within a housing of the air diffuser for movement between a closed position in which apertures of the housing are closed by the sleeve means and an open position in which they are open. Actuator means is engageable with the sleeve means for selectively moving the sleeve means between the closed and open positions and to positions therebetween so as to discharge a desired proportion of primary air through the apertures into a plenum to bypass the enclosure. Deflecting means is mounted on the housing for deflecting the primary air outwardly as it is discharged into the enclosure. The sleeve means may extend downward toward the deflecting means such that a passage of variable area is formed to further direct the primary air through the apertures. Alternatively, inlet reduction means may be included to decrease the pressure of the primary air in proximity to the apertures in the housing such that a desired proportion of secondary air is induced from the plenum through the apertures for discharge with the primary air into the enclosure. The air diffuser is particularly suited for installation in a false ceiling to provide a variable horizontal discharge of air. Automatic temperature control may also be provided.

18 Claims, 3 Drawing Figures

VARIABLE AIR DIFFUSER

BACKGROUND OF THE INVENTION

This invention relates to air diffusers which are useful in air conditioning and air circulating systems and, more particularly, to ceiling air diffusers providing variable cooling of a room by altering the flow of air to the room.

Typically, air diffusers for supplying conditioned air (primary air) to a room provide for delivery of the primary air in a pattern substantially horizontally and radially outward along the ceiling of the room. This pattern of flow serves to distribute the air from the diffuser throughout the room rather than to allow the primary air to fall directly downward from the diffuser. Occupants of the room who happen to be immediately below the diffuser may experience discomfort or drafts if the diffuser does not mix the primary air with the room air or if the diffuser does not distribute the primary air sufficiently.

As influences upon the room change, it is desirable to alter the flow of primary air to the room to maintain the comfort of occupants of the room. For example, if sunlight no longer enters the room, the amount of primary air should be decreased accordingly. Typically, for larger buildings, the speed of a central fan is controlled so as to reduce the flow of primary air and conserve fan horsepower when cooling requirements are decreased. For smaller buildings with less elaborate cooling systems, the central fan typically operates at a single speed and a separate bypass duct with a modulating damper is used. However, with such less elaborate cooling systems, there is a need for a more economical apparatus to vary the flow of primary air to a room without requiring a separate bypass duct and modulating damper.

It is, therefore, an object of the present invention to provide an air diffuser to economically vary the flow of cooling air to a room without the need to control the speed of a central cooling fan and without requiring a separate bypass duct and modulating damper.

Another problem with existing air diffusers is inadequate mixing of primary air and room air. Although a mixing of the room air with the primary air is often accomplished to some degree by standard diffuser designs, a more thorough mixing of air is desirable. Such thorough mixing provides greater comfort to occupants of the room and allows more economical temperature conditioning by the use of primary air of a lower temperature, thereby reducing the quantity of primary air required vis-a-vis diffusers providing less thorough mixing of primary air and secondary air.

Various alternatives have been proposed to accomplish a more thorough mixing of the pimary air and room air. For example, fan powered induction boxes have been installed in the primary air ducting within a plenum above a false ceiling of a room. Such induction boxes employ a fan to induce the flow of recirculated air (secondary air) from the room through the plenum into an induction box for mixing with the primary air prior to delivery of the primary air to an air diffuser. However, the additional cost of providing the separate structure of the induction box and the added fan and energy requirements make such systems impractical for many applications.

Another approach to providing more thorough mixing of primary air and room air is that of applicant's U.S. Pat. No. 4,181,253, which discloses an air diffuser providing induction of room air directly from a room to the diffuser, without drawing the secondary air through a plenum to a separate induction box. Although such an air diffuser eliminates the expense of a powered induction box and provides sufficient recirculation of room air for some applications, there is a need in other applications for an apparatus providing efficient recirculation of secondary air from more remote areas of the room.

An air diffuser proposed to provide less localized recirculation of room air is disclosed in U.S. Pat. No. 3,732,799 to Spoormaker. The air diffuser proposed therein employs a flared skirt with apertures to admit induced secondary air from a plenum above a false ceiling and a flared divider member movable in parallel relation to the skirt for regulating the flow of induced secondary air. Although the plenum facilitates recirculation of secondary air from remote areas of the room, the air diffuser proposed therein provides no mixing of the primary air and the secondary air until after the primary air and the secondary air are discharged from the air diffuser into the room.

It is, therefore, a further object of the present invention to provide an air diffuser ensuring recirculation of air from remote areas of a room, utilizing the plenum for recirculation of the room air, and providing improved mixing of the secondary air with the primary air prior to discharging the primary air and the secondary air into the room.

SUMMARY OF THE INVENTION

The present invention is directed to a novel air diffuser that provides a variable flow of either primary air or of a mixture of primary air and secondary air to an enclosure, such as a room of a building.

According to one aspect of the present invention, an air diffuser includes an apertured housing adapted to receive conditioned air (primary air) from a primary air source and adapted for installation in an opening in the enclosure. Deflecting means is mounted on the housing for deflecting the primary air outwardly as it is discharged into the enclosure. Sleeve means is movably mounted within the housing for movement between a closed position in which the apertures of the housing are substantially closed by the sleeve means and an open position in which the apertures are substantially open. Actuator means is engageable with the sleeve means for selectively moving the sleeve means between the closed and open positions and to positions therebetween so as to discharge a desired proportion of the primary air through the apertures to bypass the enclosure.

The air diffuser of the present invention is particularly well suited for installation in an opening in a false ceiling of a room such that the conditioned air (primary air) is deflected outwardly and substantially horizontally as it is discharged into the room. Preferably, the sleeve means extends downward toward the deflecting means such that a passage of variable area is formed between the sleeve means and the deflecting means and such that the passage is progressively restrictable by the movement of the sleeve means from the closed position to the open position for further directing a portion of the primary air through the apertures. The actuator means may be automatically controlled to provide a desired temperature of the room.

According to another aspect of the present invention, the air diffuser includes an inlet reduction means in addition to the structure previously described. The inlet reduction means constricts the primary air as it passes through the air diffuser so as to decrease the pressure of the primary air in proximity to apertures in a vertical portion of the housing. As a result of the added inlet reduction means, as the sleeve means is selectively moved between the closed and open positions and to positions therebetween, a desired proportion of secondary air from the room or enclosure is induced from the plenum through the apertures and into the housing for mixing with the primary air and for discharge with the primary air into the room or enclosure.

The present invention thus provides an improved and economical device for delivering primary air to a room of a building from the primary air ducting so as to deliver a variable flow of conditioned air to the room without the need for a separate bypass duct and modulating damper and without the need to control the speed of a central fan. Also, the invention provides recirculation of air from remote locations of the room by utilizing a plenum above a false ceiling of the room as a passage for secondary air and provides induction of the secondary air into the air diffuser for discharge into the room with the primary air. In this way, a separate fan powered induction box and separate ducting is not required, and mixing of the primary air and the secondary air is improved.

The invention, together with further objects and attendant advantages, will be best understood by reference to the following detailed description of the preferred embodiments taken in conjunction with the accompanying drawings.

DETAILED DESCRIPTION OF THE DRAWINGS

DESCRIPTION OF THE PREFERRED EMBODIMENTS

Figure 1:
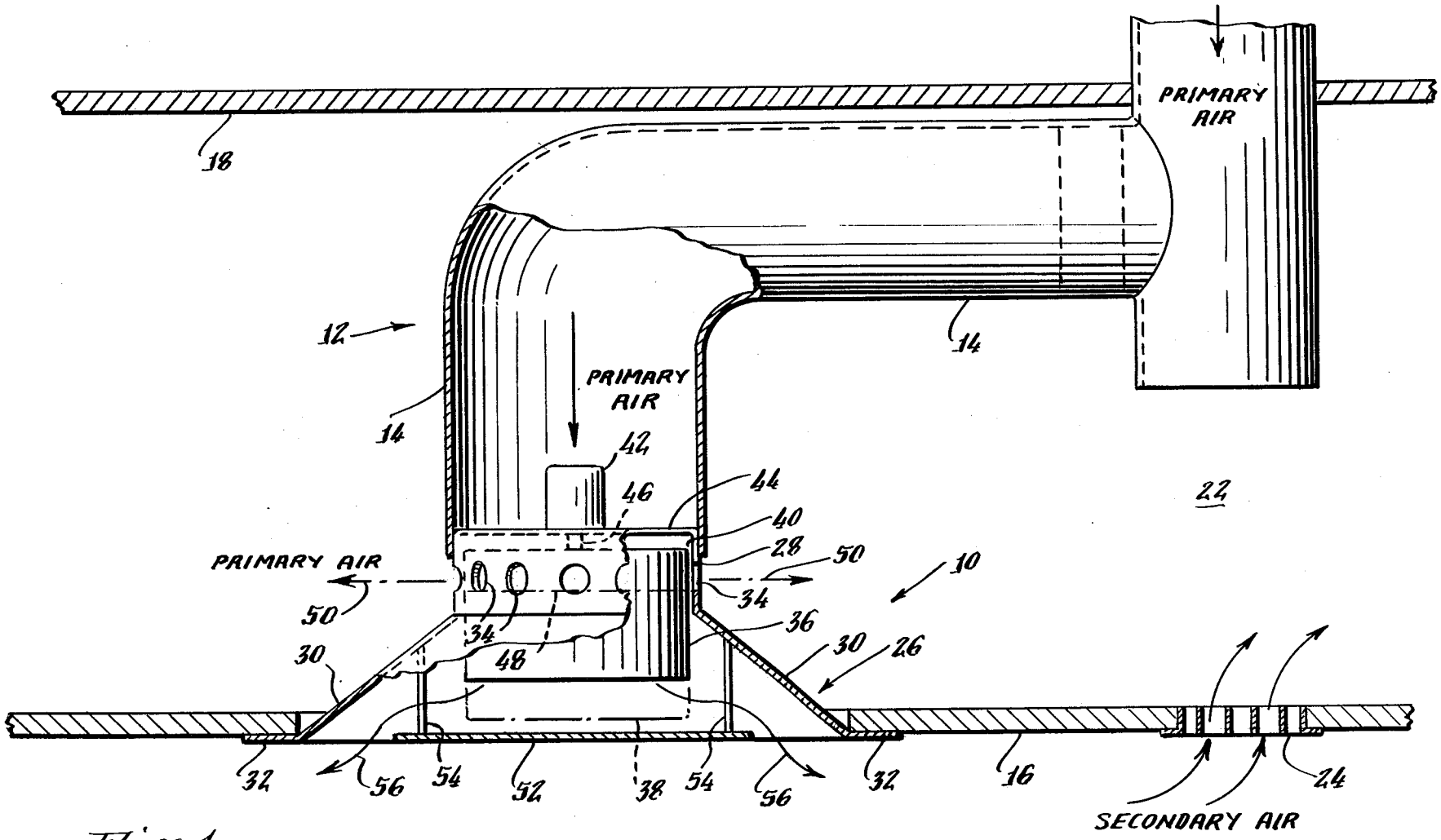
FIG. 1 is a sectional view of a portion of an air circulation system showing a ceiling air diffuser made in accordance with the present invention.

Turning now to the drawings, FIG. 1 shows a ceiling air diffuser, indicated generally by the numeral 10, made in accordance with this invention and installed in an air circulation system, indicated generally by the numeral 12. The air circulation system 12 includes a primary air source, such as for example primary air ducting 14, that carries conditioned primary air to the air diffuser 10.

As is common in many building designs, a false ceiling 16 is suspended from an adjacent ceiling structure 18 to conceal the primary air ducting 14 as well as wiring and various structural components from view from a room of the building, indicated by the numeral 20. The space between the false ceiling 16 and the adjacent ceiling structure 18, referred to as return air plenum 22, provides a path for the flow of secondary air from the room 20. To facilitate this flow of secondary air, the false ceiling 16 may be formed of porous material or may include perforations, separate slots, or openings such as, for example, those of a return air grille 24.

Preferably, the air diffuser 10 is suspended by hangers, not shown, from the adjacent ceiling structure 18 so as to be substantially flush with the false ceiling 16. Of course, the air diffuser 10 may be mounted directly on the false ceiling 16, provided that the false ceiling 16 has sufficient strength. This direct mounting of the air diffuser 10 is facilitated if the primary air ducting 14 is securely supported from the floor structure 18 by hangers or by other means.

The air diffuser 10 includes a hollow, open-ended housing, indicated generally by the numeral 26. The housing 26 has an axis and includes an axially directed collar or vertical wall portion 28 adapted to receive the primary air ducting 14, and outwardly flared side walls 30 diverging to lower wall portions 32 in engagement with the parallel to the false ceiling 16 to provide a substantially flush surface. The housing 26 may be of various configurations, circular, square, rectangular or otherwise, to provide a desired appearance and to fit the available space. Preferably, the primary air ducting 14 and the vertical wall portion 28 of the housing 26 are cylindrical; however, other configurations may be used with similar effect.

The vertical wall portion 28 of the housing 26 includes a plurality of apertures 34 providing fluid communication with the plenum 22. A hollow, open-ended sleeve 36 is movable axially within the housing 26 in close proximity to the inside surface of the vertical wall portion 28 between a closed position, shown by solid lines, in which the sleeve 36 overlies the apertures 34 and an open position, indicated by phantom lines 38, in which the apertures 34 are open to the plenum 22. Preferably, a felt gasket or bushing 40 is secured to the upper perimeter of the sleeve 36 to facilitate sliding movement of the sleeve 36 within the vertical wall portion 28 and to provide an air seal therebetween.

Actuator means 42 is mounted upon a mounting bracket 44, that may conveniently be in the form of a spider structure, within the vertical wall portion 28. The actuator means 42 is linked to the sleeve 36 so as to provide variable axial movement of the sleeve 36 relative to the vertical wall portion 28. This linkage may be by a central shaft 46 secured to a spider structure 48 that is in turn fixed to the sleeve 36. The actuator means 42 may be an electric motor, fluid piston, or other conventional power operated device. Additionally, a simple screw or linear actuator may be used to permit manual operation. Preferably, the actuator means 42 is a penumatic piston that includes the central shaft 46.

The sleeve 36 cooperates with the apertures 34 to provide a sleeve valve for delivering a desired proportion of primary air through the plenum 22 to a central conditioning unit so as to bypass the room 20, as indicated by arrows 50. As the sleeve 36 is moved downward by the actuator means 42 to the position indicated by the phantom lines 38, the apertures 34 are progressively opened. The size and number of apertures 34 are selected relative to the diffuser opening so as to obtain a desired maximum quantity of bypass air. For example, Applicant has determined that the apertures 34 may be circular and may have a combined opening of approximately one-half the normal opening of the diffuser 10 measured at its most restricted section.

A deflector plate 52 blocking the central portion of the lower open end of housing 26 is suspended from the side walls 30 in alignment with the false ceiling 16 by connector straps 54 to deflect the flow of primary air outwardly and horizontally, as indicated by arrows 56.

When the sleeve 36 is lowered to the position shown in phantom, the passage between the sleeve 36, the deflector plate 52, and the side walls 30, through which the primary air must travel to reach the room 20, is restricted. This restricted opening facilitates the directing of a portion of the primary air through the apertures 34 into the plenum 22 for return to the central conditioning unit.

The proportion of primary air directed through the apertures 34 into the plenum 22, so as to bypass the room, is dependent upon the quantity and size of the apertures 34 as well as the amount of restriction effected by the lowering of the sleeve 36. A bypass of zero to 60 percent of the primary air flowing through the ducting 14 would be a typical range of operation, although a greater maximum bypass could be achieved by providing increased movement of the sleeve 36 toward the deflector plate 52 and by providing aperture openings of a greater area than the single row of round apertures 34, shown in FIG. 1. Because of the circumferential distribution of the apertures 34 with respect to the air diffuser 10, the pattern of the discharged primary air remains belanced about the perimeter of the housing 26 throughout the range of movement of the sleeve 36.

The air diffuser 10 of FIG. 1 is particularly suitable for conditioning systems in which the flow of air through the primary air ducting is relatively constant, such as, for example, the cooling systems of smaller buildings without variable control of the speed of a central fan. It will be apparent that the diffuser 10 provides a variable flow of primary air to the room 20 by dividing the primary air of the ducting 14 between the room 20 and the plenum 22. This allows the central fan to operate at a constant speed while maintaining a constant flow of primary air through the ducting 14 at a relatively low duct pressure thereby conserving energy.

Although other sizes and flow rates may be used with similar effect, typically the air diffuser 10 has an overall housing diameter in the range of 12–30 inches, or a comparable rectangular or square configuration, and is mounted in primary air ducting 14 having a diameter of 5–14 inches and a nominal flow rate of 100–2000 cubic feet per minute. When the air diffuser 10 is thus configured, a pneumatic piston with an area of approximately 3 square inches has been found to be suitable for the actuator means 42. The housing 26 may be conveniently formed by stamping, spinning, rolling or folding aluminium or steel sheet, the particular method of fabrication being dependent upon the desired configuration.

From the above detailed description, it should be apparent that the first preferred embodiment of the present invention provides an air diffuser that can economically vary the flow of primary air to a room without the need to control the speed of a central cooling fan. Instead of altering the flow through the primary air duct or adding a bypass duct with a modulating damper, the present invention can selectively vent the cooling air directly to the plenum for return through the plenum to a central conditioning unit of the building. The actuator of the air diffuser may be controlled by a conventional thermostat or other means to provide automatic variation of the flow of cooling air.

Figure 2:
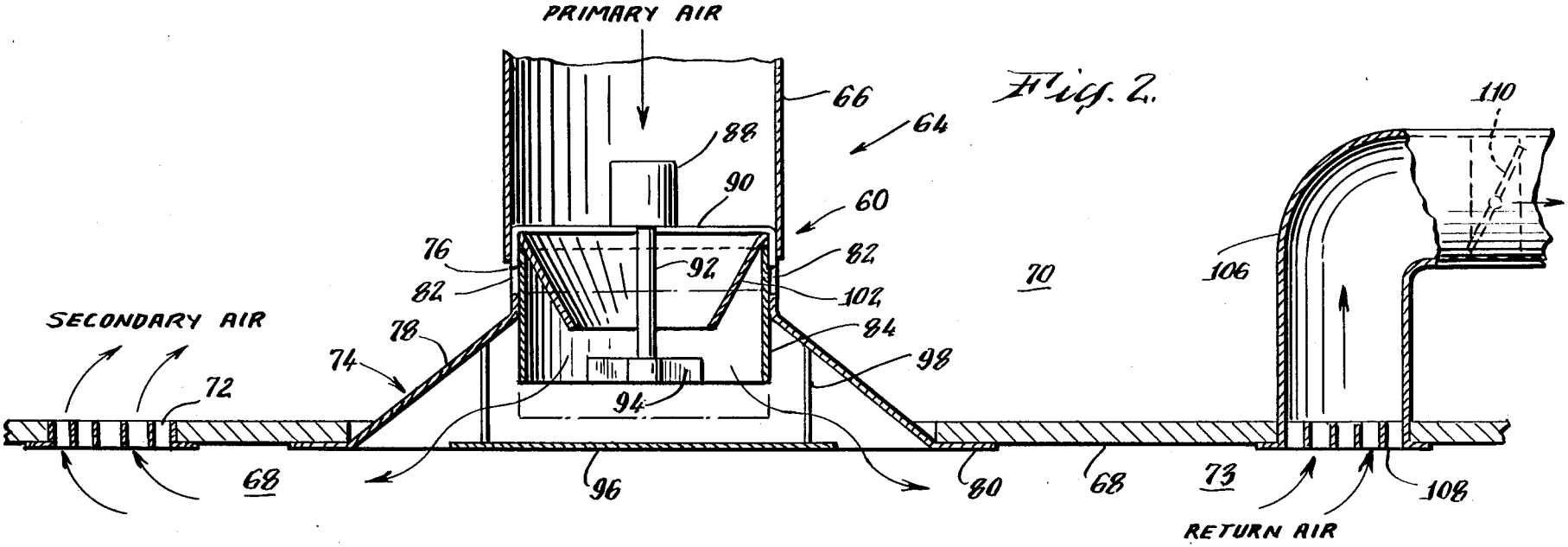
FIG. 2 is a sectional view of a portion of an air circulation system showing a second embodiment of the ceiling air diffuser of the present invention.
Figure 3:
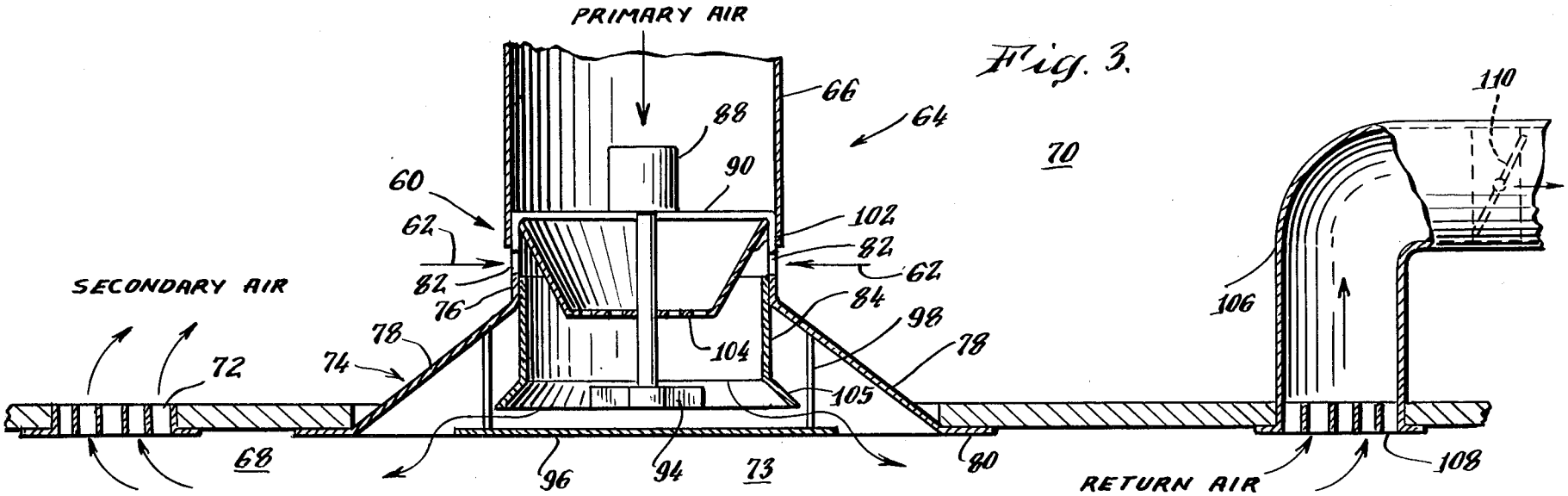
FIG. 3 is a sectional view similar to FIG. 2, showing a movable sleeve of the ceiling air diffuser in a lowered position, an inlet reducer having an optional apertured bottom wall, and the sleeve having an optional flared skirt.

A second preferred embodiment, shown in FIGS. 2 and 3, includes additional structure to provide induction of secondary air from a ceiling plenum instead of discharge of primary air into a ceiling plenum, as is provided by the first preferred embodiment. FIG. 2 shows a ceiling air diffuser, indicated generally by the numeral 60, in a closed position preventing induction of secondary air; FIG. 3 shows the air diffuser 60 including various optional features, in an open position permitting induction of secondary air, as indicated by the arrows 62.

The air diffuser 60 is installed in an air circulation system, indicated generally by the numeral 64, which includes primary air ducting 66. A false ceiling 68 is suspended from an adjacent ceiling structure, not shown, to provide a plenum 70 therebetween. The false ceiling 68 is formed of porous material or includes perforations, slots or openings such as, for example, those of a grille 72 to provide fluid communication between the plenum 70 and a room 73 below the false ceiling 68. Mounting of the air diffuser may be similar to that of the air diffuser 10, previously described.

The air diffuser 60 includes a housing indicated generally by the numeral 74, similar to that of the first preferred embodiment. The housing 74 includes a collar or vertical wall portion 76, adapted to receive the primary air ducting 66, and outwardly flared side walls 78, diverging to lower wall portions 80, in engagement with and parallel to the false ceiling 68 to provide a substantially flush surface. Like the housing 26, the housing 74 may be of various configurations, e.g., square, rectangular or round, to provide a desired appearance and fit. The vertical wall portion 76 includes a plurality of apertures 82 providing fluid communication with the plenum 70.

A sleeve 84 is movable axially in close proximity to the inside surface of the vertical wall portion 76 between the closed position, shown in FIG. 2, in which the sleeve 84 overlies and closes the apertures 82, and the open position shown in FIG. 3, in which the apertures 82 are open. Preferably, a felt gasket or bushing is secured to the sleeve 84 to facilitate sliding movement and to provide an air seal. Actuator means 88 similar to the actuator means 42 is linked to the sleeve 84 by a central shaft secured to a spider structure 94. A deflector plate 96 is suspended from the side walls 78 in alignment with the false ceiling 68 by connector straps 98 to deflect the flow of primary air outwardly and horizontally, as indicated by the arrows 100.

Unlike the first preferred embodiment, the air diffuser 60 includes an inlet reducer 102, which may conveniently be a converging truncated cone, fixed to the vertical wall portion 76. The inlet reducer 102 creates a venturi effect to increase the velocity and decrease the pressure of the primary air as it enters the air diffuser 60. An optional bottom wall 104 with the apertures or nozzles may be provided at the lower end of the inlet reducer 102,as shown in FIG. 3. The apertures or nozzles of the bottom wall 104 serve to further constrict the inlet to the air diffuser 60 and increase the venturi effect.

As a result of the low pressure within the air diffuser 60 adjacent the vertical wall portion 76, secondary air from the plenum 70 is drawn through the apertures 82 when the sleeve 84 is lowered to the position shown in FIG. 3. This induced secondary air mixes with the primary air within the air diffuser 60 before the air enters the room, so as to avoid discomfort of persons within the room due to exposure to unmixed primary air. Preferably, the actuator means 88 is infinitely variable so as to provide any desired ratio of secondary air to primary air up to the maximum provided when the apertures 82 are open, as shown in FIG. 3. The sleeve 84 may include an optional flared skirt 105 to aid in directing the flow of mixed primary air and secondary air outward along the deflector plate 96. The sleeve 36 of the first preferred embodiment may be configured similarly to achieve a similar effect.

With the second preferred embodiment, instead of utilizing the plenum 70 for the flow of return air to a central conditioning unit, preferably, secondary air is returned to the central conditioning unit by a separate return air duct 106 that is open to the room 73 by a grille 108 or by other, similar means. Control of the flow of return air may be provided by a damper 110, so as to balance the flow of air throughout a building.

It will be appreciated that as the sleeve 84 is lowered to increase the induction of secondary air through the apertures 82, the opening between the sleeve 84 and the deflector plate 96 is reduced, thus restricting the flow of primary air into the room. This restriction is particularly advantageous in conditioning systems in which the speed of the central fan can be reduced in response to a pressure sensor so as to decrease energy utilization. Because the plenum 70 typically houses lighting fixtures and achieves an elevated temperature due to the tendency of warm air to rise, the variable induction of secondary air from the plenum 70 provides a wide range in the temperature of the mixture of primary air and secondary air discharged into the room.

Although other sizes and flow rates may be used with similar effect, typically the induction air diffuser 60 has an overall housing configuration and actuator means similar to those of the bypass air diffuser 10 and is mounted in primary air ducting having a flow rate similar to that of the primary air ducting of the bypass air diffuser 10. When provided with a single row of round apertures 82, or with apertures of a similar area, the air diffuser 60 may provide induction of zero to 0.4 cubic feet per minute per 1.0 cubic feet per minute of primary air. Greater induction may be provided by increasing the area of the apertures 82 and by increasing the venturi effect.

It should be apparent that the second preferred embodiment of the present invention provides an air diffuser for economically mixing a selected quantity of secondary air from a room with primary air before discharging the combined primary air and secondary air into the room. Unlike the induction boxes of the prior art, there is no need for a structure separate from the diffuser to provide for mixing of the primary air and the secondary air and there is no need for a powered fan to induce the flow of secondary air. For this mode of operation, the plenum is utilized as a path for the secondary air from various locations of the room to the diffuser for recirculation to the room. As with the first preferred embodiment, the actuator means 88 may be controlled by a conventional thermostat or by other means to provide automatic control of the temperature of the room.

Accordingly, although specific embodiments of the above invention have been described in detail, it is to be understood that this is for the purpose of illustration only. Of course, various changes and modifications to the preferred embodiments described above will be apparent to those skilled in the art. For example, the diffuser of the invention may be mounted in a wall other than the ceiling and may be used in other enclosures than rooms of buildings. Such changes and modifications can be made without departing from the spirit and scope of the present invention, and it is therefore intended that such changes and modifications be covered by the following claims.

What is claimed is:

1. A variable air diffuser for discharging conditioned air (primary air) into an enclosure, comprising:

a hollow, open-ended housing having an axis and adapted to receive primary air from a primary air source, the housing being adapted for installation in an opening in a wall of the enclosure, the housing having an axially directed surface with apertures for providing fluid communication with a plenum outside the enclosure;

deflecting means mounted on the housing for blocking part of its open end and deflecting the primary air outwardly as it is discharged into the enclosure;

sleeve means movably mounted within the axially directed surface of the housing and coaxial thereto so as to be axially movable between a closed position in which the apertures of the housing are substantially closed by the sleeve means and an open position in which the apertures of the housing are substantially open; and actuator means engageable with the sleeve means for selectively moving the sleeve means between the closed and open positions and to positions therebetween so as to cause a desired quantity of air to flow between the plenum and the air diffuser to alter the flow of the primary air discharged into the enclosure.

2. The variable air diffuser of claim 1 wherein a passage of variable area is formed between the sleeve means and the deflecting means, said passage being progressively restrictable by the movement of the sleeve means from the closed position to the open position so as to facilitate directing of a portion of the primary air outward through the apertures into the plenum to bypass the enclosure.

3. The variable air diffuser of claim 1 further comprising inlet reduction means mounted on the housing for constricting the path of the primary air as it passes through the air diffuser so as to decrease the pressure of the primary air within the diffuser in proximity to the apertures of the housing so as to induce a desired proportion of recirculated air (secondary air) into the housing for mixing with the primary air and for discharge with the primary air into the room when the sleeve means is in the open position.

4. A variable air diffuser for discharging conditioned air (primary air) into an enclosure, comprising:

a hollow, open-ended housing adapted for mounting within a wall of the enclosure and adapted to receive primary air from a source, the housing having apertures for providing diversion of primary air away from the enclosure;

deflecting means mounted on the housing for blocking part of its open end and deflecting the primary air as it is discharged into the enclosure;

sleeve means movably mounted within the housing so as to be movable to provide variable opening of the apertures, the sleeve means coacting with the deflecting means to restrict flow of primary air into the enclosure and direct primary air through the apertures when the sleeve means is moved to open the apertures; and actuator means engageable with the sleeve means for selectively moving the sleeve means to provide a desired opening of the apertures.

5. A variable ceiling air diffuser for discharging conditioned air (primary air) into a room of a building, comprising:

a hollow, open-ended housing adapted to receive primary air from a source, the housing having a vertical wall portion and diverging side walls extending downward therefrom for engagement with a false ceiling of the room, the vertical wall portion having apertures for providing fluid communication with a plenum above the false ceiling;

deflecting means mounted on the housing for blocking part of its open end and deflecting the primary air outwardly and substantially horizontally as it is discharged into the room;

sleeve means movably mounted within the vertical wall portion of the housing so as to be movable downward from a closed position in which the apertures of the vertical wall portion are closed by the sleeve means to an open position in which the apertures of the vertical wall portion are open, and actuator means engageable with the sleeve means for selectively moving the sleeve means between the closed and open positions and to positions therebetween so as to discharge a desired proportion of the primary air into the room and to discharge the remainder of the primary air through the apertures into the plenum above the false ceiling to bypass the room.

6. The variable ceiling air diffuser of claim 5 wherein the sleeve means extends below the vertical wall portion such that a passage of variable area is formed between the sleeve means and the deflecting means, said passage being progressively restrictable by the movement of the sleeve means from the closed position to the open position.

7. The variable ceiling air diffuser of claim 5 wherein the vertical wall portion of the housing is cylindrical and wherein the sleeve means is a cylindrical sleeve member slidably movable axially within the vertical wall portion so as to progressively open the apertures of the vertical portion as the sleeve member is moved axially downward with respect to the vertical portion.

8. The variable ceiling air diffuser of claim 5 wherein the vertical portion of the housing is a tubular structure having a row of apertures within a substantially horizontal plane.

9. The variable ceiling air diffuser of claim 5 wherein the side walls are engageable with the false ceiling to provide a substantially flush surface and wherein the deflector means is planar and is fixed to the housing such that it is substantially in alignment with the false ceiling.

10. The variable ceiling air diffuser of claim 5 wherein the sleeve means includes an outwardly flared lower portion to aid in directing the flow of primary air along the deflecting means.

11. A variable ceiling air diffuser for discharging conditioned air (primary air) into a room of a building, comprising:

a hollow, open-ended housing adapted to receive primary air from a primary air duct, the housing including a cylindrical vertical wall portion having apertures distributed to circumferentially and diverging side walls extending downward from the vertical wall portion for engagement with a false ceiling of the room to provide a substantially flush appearance;

a deflector plate suspended from the housing so as to be substantially in alignment with the false ceiling of the room, blocking a central part of the housing's open end for deflecting the primary air outwardly and substantially horizontally as it is discharged into the room;

a cylindrical sleeve member movably mounted within the vertical wall portion of the housing so as to be axially movable downward from a closed position in which the apertures of the vertical wall portion are closed by the sleeve member to an open position in which the apertures of the vertical wall portion are open, the sleeve member coacting with the deflector plate to form a variable passage therebetween, said passage being progressively restrictable by the movement of the sleeve member from the closed position to the open position; and actuator means in engagement with the sleeve member for selectively moving the sleeve member between the closed position and the open position and to positions therebetween so as to deliver a desired proportion of the primary air to the room via said passage and the remainder of the primary air to a plenum above the false ceiling via the apertures of the vertical portion of the housing, thereby bypassing the room.

12. A variable ceiling air diffuser for discharging a mixture of conditioned air (primary air) and recirculated air (secondary air) into a room of a building, comprising:

a hollow, open-ended housing adapted to receive primary air from a primary air source, the housing having a vertical wall portion and diverging side walls extending downward therefrom so as to be engageable with a false ceiling of the room, the vertical portion having apertures for providing fluid communication with secondary air within a plenum above the false ceiling;

deflecting means mounted on the housing for blocking part of its open end and deflecting the primary air outwardly and substantially horizontally as it is discharged into the room;

inlet reduction means mounted on the housing for constricting the path of the primary air as it passes through the air diffuser so as to decrease the pressure of the primary air within the air diffuser in proximity to the apertures of the vertical wall portion;

sleeve means movably mounted within the vertical wall portion of the housing so as to be movable downward from a closed position in which the apertures of the vertical wall portion are closed by the sleeve means to an open position in which the apertures of the vertical wall portion are open; and actuator means engageable with the sleeve means for selectively moving the sleeve means between the closed position and the open position and to positions therebetween so as to draw a desired proportion of the secondary air thorugh the apertures into the housing for mixing with the primary air and for subsequent discharge with the primary air into the room.

13. The variable ceiling air diffuser of claim 12 wherein the vertical wall portion of the housing is cylindrical and wherein the sleeve means is a cylindrical sleeve member slidably movable axially within the vertical wall portion and in close proximity thereto so as to progressively open the apertures of the vertical portion as the sleeve member is moved axially downward with respect to the vertical wall portion.

14. The variable ceiling air diffuser of claim 12 wherein the vertical portion of the housing is a tubular structure having a row of apertures within a horizontal plane.

15. The variable ceiling air diffuser of claim 12 wherein the side walls are engageable with the false ceiling to provide a substantially flush surface and wherein the deflector means is planar and is fixed to the housing such that it is substantially in alignment with the false ceiling.

16. The variable ceiling air diffuser of claim 12 wherein the inlet reduction means is a conveying truncated cone for the passage of the primary air as it enters the air diffuser.

17. The variable ceiling air diffuser of claim 12 wherein the sleeve means includes an outwardly flared lower portion to aid in directing the flow of primary air along the deflecting means.

18. A variable ceiling air diffuser for discharging a mixture of conditioned air (primary air) and recirculated air (secondary air) into a room of a building comprising:

a hollow, open-ended housing adapted to receive primary air from a primary air duct, the housing including a cylindrical vertical wall portion having apertures distributed circumferentially and diverging side walls extending downward from the vertical wall portion and engageable with a false ceiling of the room to provide a substantially flush appearance;

a deflector plate suspended from the housing so as to be substantially in alignment with the false ceiling of the room, blocking a central part of the housing's open end for deflecting the discharge of primary air and secondary air outwardly and substantially horizontally as it is discharged into the room;

a converging truncated cone mounted on the housing, for constricting the passage of the primary air as it enters the air diffuser, so as to decrease the pressure of the primary air within the air diffuser in proximity to the apertures of the vertical wall portion by venturi effect;

a cylindrical sleeve member movably mounted within the vertical wall portion of the housing so as to be axially movable downward from a closed position in which the apertures of the vertical wall portion are closed by the sleeve member to an open position in which the apertures of the vertical wall portion are open, the sleeve member coacting with the deflector plate to form a variable passage therebetween, said passage being progressively restrictable by the movement of the sleeve member from the closed to the open position; and actuator means engageable with the sleeve member for selectively moving the sleeve member between the closed position and the open position and to positions therebetween so as to draw a desired proportion of the secondary air through the apertures into the housing for mixing with the primary air and for subsequent discharge with the primary air into the room.

* * * * *